US007296315B2

(12) United States Patent
Totton et al.

(10) Patent No.: US 7,296,315 B2
(45) **Date of Patent: *Nov. 20, 2007**

(54) AIR-POWERED LOW INTERFACE PRESSURE SUPPORT SURFACE

(75) Inventors: Wanda J. Totton, Greer, SC (US); Richard W. Raburn, Simpsonville, SC (US); Russell J. Weston, Greer, SC (US); Joseph Benedict, Mauldin, SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/929,311

(22) Filed: Aug. 30, 2004

(65) Prior Publication Data

US 2005/0022308 A1 Feb. 3, 2005

Related U.S. Application Data

(63) Continuation of application No. 09/907,954, filed on Jul. 18, 2001, now Pat. No. 6,782,574.

(60) Provisional application No. 60/219,074, filed on Jul. 18, 2000.

(51) Int. Cl.
*A61G 7/057* (2006.01)
*A47C 27/10* (2006.01)

(52) U.S. Cl. ..... 5/737; 5/500

(58) Field of Classification Search ..... 5/710, 5/713–715, 726, 737, 738, 691, 500, 502
See application file for complete search history.

(56) References Cited

U.S. PATENT DOCUMENTS 3,317,934 A * 5/1967 Hinrichs ..... 5/422
3,644,950 A * 2/1972 Lindsay, Jr. ..... 5/709
3,757,366 A 9/1973 Sacher
3,778,851 A 12/1973 Howorth
4,091,482 A * 5/1978 Malcolm ..... 5/413 R
4,225,989 A 10/1980 Corbett et al.
4,267,611 A 5/1981 Agulnick
4,317,244 A * 3/1982 Balfour-Richie ..... 5/706
4,347,633 A 9/1982 Gammons et al.
4,391,009 A 7/1983 Schild et al.
4,483,030 A 11/1984 Flick et al.
4,653,130 A 3/1987 Senoune et al.
4,704,753 A * 11/1987 Lunt ..... 5/484
4,744,118 A * 5/1988 Lunt ..... 5/487
4,862,538 A 9/1989 Spann et al.
4,944,060 A 7/1990 Peery et al.

(Continued)

*Primary Examiner*—Robert Canfield
*Assistant Examiner*—Gay Ann Spahn
(74) *Attorney, Agent, or Firm*—Dority & Manning, P.A.

(57) ABSTRACT

An air inflatable mattress and mattress coverlet are provided for the prevention and treatment of decubitus ulcers (i.e., pressure sores or bedsores). The mattress incorporates a user selectable static or alternating air powered support surface for more uniformly redistributing pressure exerted on a patient's skin. The mattress coverlet encompasses a low air loss feature independent of the mattress's user selectable air powered support surface. Such low air loss feature provides a patient contact surface exhibiting a high moisture vapor transfer ratio in conjunction with a forced air flow to aid in reducing the moisture and heat near the patient's body. Both the mattress and mattress coverlet are driven by an external control system which houses the user controls, as well as the necessary pumps, regulators, and valving.

17 Claims, 8 Drawing Sheets

U.S. PATENT DOCUMENTS 4,970,743 A 11/1990 Wride et al.
4,989,285 A * 2/1991 Troncone et al. ..... 5/482
5,010,608 A 4/1991 Barnett et al.
5,022,110 A * 6/1991 Stroh ..... 5/710
5,103,519 A 4/1992 Hasty
5,152,021 A * 10/1992 Vrzalik ..... 5/715
5,168,589 A * 12/1992 Stroh et al. ..... 5/710
5,216,768 A 6/1993 Bodine et al.
5,370,439 A 12/1994 Lowe et al.
5,375,273 A 12/1994 Bodine, Jr. et al.
D355,488 S 2/1995 Hargest et al.
5,421,044 A * 6/1995 Steensen ..... 5/710
5,487,196 A 1/1996 Wilkinson et al.
5,493,742 A * 2/1996 Klearman ..... 5/423
5,509,155 A * 4/1996 Zigarac et al. ..... 5/655.3
5,568,660 A 10/1996 Raburn et al.
5,687,438 A 11/1997 Biggie et al.
5,699,570 A * 12/1997 Wilkinson et al. ..... 5/713
5,727,266 A * 3/1998 Pang ..... 5/490
5,728,147 A * 3/1998 Thomas ..... 607/112
5,755,000 A * 5/1998 Thompson ..... 5/713
5,797,155 A 8/1998 Maier et al.
5,870,785 A 2/1999 Hoorens
5,881,409 A * 3/1999 Pearce ..... 5/702
5,882,349 A * 3/1999 Wilkerson et al. ..... 604/289
5,887,304 A * 3/1999 von der Heyde ..... 5/726
5,926,884 A * 7/1999 Biggie et al. ..... 5/714
5,987,668 A 11/1999 Ackley
5,996,148 A * 12/1999 McCain et al. ..... 5/497
6,058,535 A * 5/2000 Firkins, Jr. et al. ..... 5/653
6,158,070 A * 12/2000 Bolden et al. ..... 5/689
6,223,369 B1 * 5/2001 Maier et al. ..... 5/713
6,467,106 B1 * 10/2002 Heimbrock ..... 5/81.1 C
6,582,456 B1 * 6/2003 Hand et al. ..... 607/108
6,782,574 B2 * 8/2004 Totton et al. ..... 5/713
2002/0129449 A1 * 9/2002 Harker ..... 5/726
2002/0148047 A1 * 10/2002 Corzani et al. ..... 5/738
2002/0178506 A1 * 12/2002 Corzani et al. ..... 5/737
2003/0070226 A1 * 4/2003 Heimbrock ..... 5/81.1 R

* cited by examiner

AIR-POWERED LOW INTERFACE PRESSURE SUPPORT SURFACE

PRIORITY CLAIM

This application is a continuation of U.S. patent application Ser. No. 09/907,954 filed Jul. 18, 2001 entitled "AIR-POWERED LOW INTERFACE PRESSURE SUPPORT SURFACE" and now U.S. Pat. No. 6,782,574 issued on Aug. 31, 2004. which, in turn, claimed benefit of U.S. Provisional Application No. 60/219,074, filed Jul. 18, 2000, both of which are incorporated herein by reference for all purposes.

BACKGROUND OF THE INVENTION

This invention generally relates to mattresses and mattress coverlets for preventing, reducing, and/or treating decubitus ulcers, also known as pressure sores or bedsores. More particularly, this invention concerns therapeutic mattresses or mattress coverlets capable of transferring or dissipating moisture vapor and heat from a patient's skin.

Often, patients that are bedridden or immobile can develop decubitus ulcers (pressure sores or bedsores). Such ulcers are often caused by pressure, friction, shear, moisture, and heat. Pressure results in a reduction of blood flow to the soft tissues of the body, particularly the skin. Continuous lack of blood flow, and the resultant lack of oxygen, can cause the skin to die and ulcers or sores to form. Friction and shear of the skin against the support surface can lead to skin tears and decubitus ulcers. Moisture and heat may lead to skin maceration. Other factors play a part in determining the speed with which such ulcers will form or heal including the overall health of the patient and such patient's nutritional status.

To insure normal (or, at least, relatively improved) blood flow to such areas of potentially problematic contact, patients are often turned or repositioned regularly by medical personnel. Turning or repositioning of patients, however, is not always possible, particularly where trained medical staff are not available. Additionally, repositioning can be painful and disruptive for the patient. In an effort to overcome such difficulties, numerous mattresses and mattress coverlets have been developed to more evenly distribute, across the patient's skin, the pressure generated by the weight of the body. At least two methods have been used to redistribute skin pressure. The first is the use of static supports such as foam, air or water mattresses. The second method involves the use of alternating pressure inflatable mattresses or mattress coverlets that dynamically shift the location of support under the patient. Two examples of alternating pressure inflatable surfaces are illustrated in U.S. Pat. Nos. 5,509,155 and 5,926,884, the disclosures of which are fully incorporated herein by reference.

In addition to such two methods of redistribution of skin pressure, an additional feature has been utilized to help address other of the aforementioned factors important to the healing process. In particular, a low air loss feature has been used to aid in the removal of both moisture vapor and heat thereby reducing both at the patient-bed boundary. This has been done in an effort to prevent skin maceration, keep wounds dry and to promote healing.

There have been essentially three approaches to achieving a low air loss support surface. First, relatively tiny holes can be provided in the top surface of inflatable air cells of an air mattress having a vapor-permeable top surface. Such holes allow extra air to circulate inside the mattress to assist in drying moisture vapor passing through the top surface from the patient.

Second, relatively tiny holes can be provided in the top surface of the mattress so that the air venting from the air cells can transfer through the top surface to the patient in order to remove both heat and moisture from the area immediately surrounding the patient.

Finally, a multi-layer mattress coverlet can be used wherein the top layer is perforated to allow air flowing between the top layer and a middle vapor-permeable layer to exhaust across the patient thus aiding in removing both moisture and heat from the area immediately surrounding the patient. The third layer of such a three-layer approach may be a three-dimensional fabric, which allows for additional moisture vapor to be carried away from the patient.

While each of these approaches is useful for its purpose, there are various disadvantages with these approaches and in particular, with using them individually. The first and second referenced approaches to obtaining a low air loss feature requires a large compressor pump to maintain sufficient air to inflate the air cells of the mattress. Such large compressor pumps tend to be very noisy, require high electrical consumption and generate significant heat in a relatively confined area. Such high electrical consumption, and the additional need for continuous blower operation, has, in the past, resulted in over-heating of the air used to circulate about the patient. Conversely, in the case of an elderly patient, airflow directly across their body could result in an uncomfortable reduction in body temperature or even a drying out of the skin beyond that which is helpful.

Additionally, having holes in air cells of an inflatable air system results in a support surface that will deflate if there is a loss of electrical power or if no such power supply is available. Further, having perforations in the patient-bed contact surface results in a mattress that is not fluid-proof. This allows for potential contamination of the interior of such mattress by bodily fluids, products used to treat the patient and/or products used to clean such mattress itself. All three referenced approaches fail to allow air to flow under load (i.e., underneath the patient or through the top surface to the patient's skin when supporting the weight of the patient).

Similarly, some prior art mattresses and mattress coverlets have had difficulty in controlling billowing. Billowing is the uncontrolled inflation of the upper surface of a mattress or mattress coverlet in the area immediately surrounding the outline of a patient's body when the patient lies on the mattress. In essence, the mattress or mattress coverlet fails to fully support a patient and instead seemingly envelops them when the patient's weight is applied thereto. Thus further illustrating the failure of some prior mattresses and/or mattress coverlets to fully support the patient and thus resulting in the air flow through the mattress, mattress top layer, or through the coverlet (i.e., the three aforementioned approaches) to flow around the patient, rather than flowing underneath the patient to aid in controlling moisture and heat.

With all of the above approaches, it is further unknown to have the capability to turn on or off the low air loss option while retaining through the use of powered air cells the redistribution of skin pressure feature of the mattresses or mattress coverlets. If a low air loss therapy is not desired, a different system must be utilized with an alternative controller and air cell array.

SUMMARY OF THE INVENTION

The present invention recognizes and addresses various of the foregoing limitations and drawbacks, and others, concerning the prevention and/or treatment of decubitus ulcers. It is, therefore, a principle object of the subject invention to provide an improved mattress and/or mattress coverlet for use in the prevention and treatment of decubitus ulcers. More particularly, it is a principle object of the subject invention to provide a mattress and/or mattress coverlet incorporating an air circulation system that does not exhaust its air directly across the patient.

Another more particular object of the subject invention is to provide a new air flotation mattress and/or mattress coverlet including a low air loss feature. In such context, it is a further object to provide a mattress and/or mattress coverlet wherein the low air loss feature can be turned on or off as desired for the treatment of the patient, independently of how the basic patient support surface is operated.

It is still a further object of the present invention to provide a mattress and/or mattress coverlet including a three-dimensional non-crush fabric to allow for the airflow of such a low air loss feature to flow under load.

Another general object of the subject invention is to provide a mattress capable of selectively providing either an alternating pressure inflatable support or a floatation support for the redistribution of skin pressure.

It is still a further object of the subject invention to provide a self contained external control system (ECS) including at least two pumps which are required to respectively maintain both the inflation of the mattress support and, if desired, the low air loss feature of the mattress coverlet. In such context, it is a further object of the present invention to provide a mattress or mattress coverlet capable of maintaining inflation of the patient support surface during a loss or unavailability of electrical power.

Another object of the present invention is to provide an independently usable low air loss coverlet, which may be combined with various support scenarios, such as with preexisting mattress support systems, patient positioners, and/or wheelchair/seating cushions (as a retrofit or as original equipment combined with a prior design), regardless of whether such prior systems incorporate an air powered patient support surface.

Additional objects and advantages of the invention are set forth in, or will be apparent to those with ordinary skill in the art from the detailed description herein. Also, it should be further appreciated that modifications and variation to the specifically illustrated, referenced, and discussed features, materials, or devices hereof may be practiced in various uses and embodiments of this invention without departing from the spirit and scope thereof, by virtue of present reference thereto. Such variations may include, but are not limited to, substitution of equivalent materials, means, or features for those shown, referenced or discussed, and the functional, operational, or positional reversal of various features, parts or the like.

Still further, it is to be understood that different embodiments, as well as different presently preferred embodiments, of this invention may include various combinations or configurations of presently disclosed features, or elements, or their equivalents (including combinations of features or configurations thereof not expressly shown in the figures or stated in the detailed description).

One exemplary embodiment of the present invention includes an air flotation mattress with an ECS. The support surface of such air flotation mattress may include a foam shell with a surface treatment on its upper surface. An exemplary GEO-MAT® surface treatment is illustrated in commonly owned U.S. Pat. No. 4,862,538, which is fully incorporated herein by reference. Such surface treatment aids in redistributing skin pressure. Additionally, the air floatation mattress includes a plurality of air cells running side-to-side providing the ability to sub-divide the mattress support into pre-designated zones.

Included with such an exemplary air flotation mattress may be a low air loss coverlet in accordance with the subject invention. Such air flotation mattress serves as the primary support surface offering both a flotation and alternating pressure treatment option. Such low air loss coverlet provides an option to enhance the process of removing moist warm air from the area around the skin of the patient. It achieves such function by employing a patient-contact fabric top layer possessing a high moisture vapor transfer ratio enhanced by airflow through an inner layer of the coverlet.

Such a mattress coverlet preferably comprises three layers. The first layer (on the top, facing the patient interface) is a vapor permeable layer, which allows moisture vapor and heat to travel away from the patient's body. Such moisture vapor enters the second layer, which may comprise a non-crush three-dimensional fabric, such as a specialty knit. The ECS forces air through the second (i.e., middle) layer to aid in carrying away the warm moist air. The final layer of such mattress coverlet (furthest from the patient interface) is a waterproof, vapor impermeable layer that acts as a boundary to protect the underlying mattress.

The mattress coverlet's third layer may additionally comprise a coverlet-mattress topper such as a zippered sheath for encasing a mattress. Such construction advantageously enables the coverlet to effectively function with any mattress and not just the air flotation mattress as disclosed herein. Accordingly, various embodiments of the subject invention may comprise a mattress coverlet in accordance with the subject invention, combined with a variety of underlying patient support surfaces, including a mattress, patient positioner, and/or wheelchair/seating cushion (regardless of whether pre-existing, disclosed herewith, or later developed).

Yet another exemplary embodiment of the present invention includes an air flotation mattress with an ECS. The air flotation mattress includes a plurality of air cells running head-to-foot. A foam shell topper with foam bolsters and foam sides running the length of the mattress on either side forms the air flotation mattress. At each end of the air flotation mattress and capping the foam bolsters and sides is either a foam header or foam footer, which along with the bolsters form a cavity in the mattress. This cavity is for positioning of the air cells.

Included with such an exemplary air flotation mattress may be a low air loss coverlet in accordance with the subject invention. Such air flotation mattress serves as the primary patient support surface. Such low air loss coverlet provides an option to enhance the process of removing moist warm air from the area around the skin of the patient. It achieves such function by employing a patient-contact fabric top layer possessing a high moisture vapor transfer ratio enhanced by airflow through an inner layer of the coverlet.

Such a mattress coverlet preferably comprises two layers. The first layer (on the top, facing the patient interface) is a vapor permeable layer, which allows moisture vapor and heat to travel away from the patient's body. Such moisture vapor enters the second layer, which may comprise a non-crush three-dimensional fabric. The ECS forces air through the second layer of such mattress coverlet to aid in carrying away the warm moist air.

The air floatation mattress additionally comprises a multi-layer mattress topper comprising three layers. The first layer of such multi-layer mattress topper (adjacent such a mattress coverlet) is a waterproof, vapor impermeable layer that performs as a boundary to protect the underlying mattress. The second layer may comprise a non-crush three-dimensional fabric. The ECS forces air through the second (i.e., middle) layer in addition to providing airflow through the second layer of such a companion low air loss mattress coverlet.

The multi-layer mattress topper's third layer may comprise a waterproof, vapor impermeable layer that performs as a boundary to protect the underlying mattress. The topper's third layer serves as the basis for a zippered sheath for encasing such a foam-based portion of the mattress. The multi-layer mattress topper's first and third layers are welded around their perimeter so as to secure their construction.

Similarly, the two layers of such a coverlet are sewn together around their perimeter and may utilize an elasticized band there-around for securing the coverlet to the mattress. Such construction advantageously enables the coverlet to effectively function with any mattress and not just the air flotation mattress as disclosed herein. Accordingly, various embodiments of the subject invention may comprise a mattress coverlet in accordance with the subject invention, combined with a variety of underlying patient support surfaces, including a mattress, patient positioner, and/or wheelchair/seating cushion (regardless of whether pre-existing, disclosed herewith, or later developed).

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
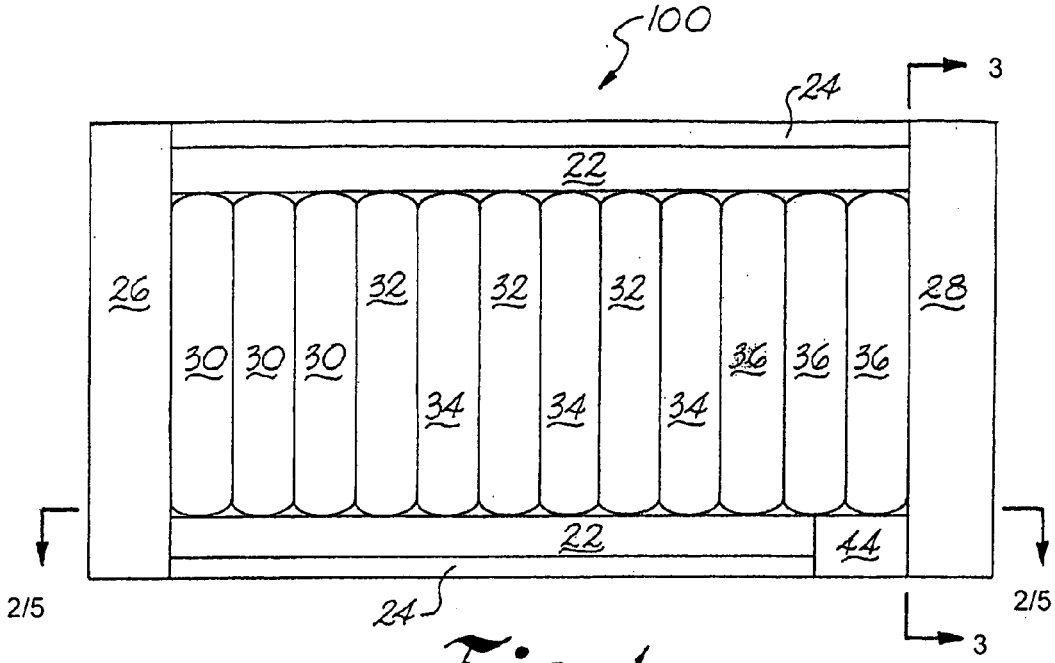
FIG. 1 is a bottom elevational view of an exemplary air flotation mattress in accordance with the subject invention with exemplary foam bolsters, sides, header, and footer, and individual air cell features of such exemplary mattress running side-to-side.

Repeat use of reference characters throughout the present specification and appended drawings is intended to represent same or analogous features, aspects, or elements of the invention.

DETAILED DESCRIPTION OF THE PREFERRED EMBODIMENTS

Reference will now be made in detail to a presently preferred embodiment of the invention, an example of which is discussed in conjunction with the accompanying drawings. Such example is provided by way of an explanation of the invention, not limitation thereof. In fact, it will be apparent to those skilled in the art that various modifications and variations can be made in the present invention, without departing from the spirit and scope thereof. For instance, features illustrated or described as part of one embodiment can be used on or in another embodiment to yield a still further embodiment. Still further, variations in selection of materials and/or characteristics may be practiced, to satisfy particular desired user criteria. Thus, it is intended that the present invention cover such modifications and variations as come within the scope of the present features and their equivalents.

As referenced above, the present invention is particularly concerned with, in exemplary broad terms, an air flotation mattress 100 and mattress coverlet 200 for the prevention and treatment of decubitus ulcers (pressure sores and bedsores). The air flotation mattress 100 provides a user selectable flotation or alternating pressure support surface. The mattress coverlet 200 provides a low air loss feature that can be turned on or off as desired by the user (here, broadly referencing a patient or person resting on such coverlet and/or a caregiver therefore).

As shown in the bottom elevational view of FIG. 1, the air flotation mattress 100 is formed by a foam shell topper 20 (best seen in FIGS. 2 and 3) with foam bolsters 22 and foam sides 24 running the length of the mattress 100 on either side. At the respective ends of the air flotation mattress 100 and capping the foam bolsters and sides 22 and 24, respectively, are a foam header 26 and foam footer 28, which along with the bolsters 22 form a cavity in the mattress 100. This cavity is for positioning of air cells, such as the exemplary grouped (i.e., zoned) air cells 30, 32, 34 and 36.

Figure 6:
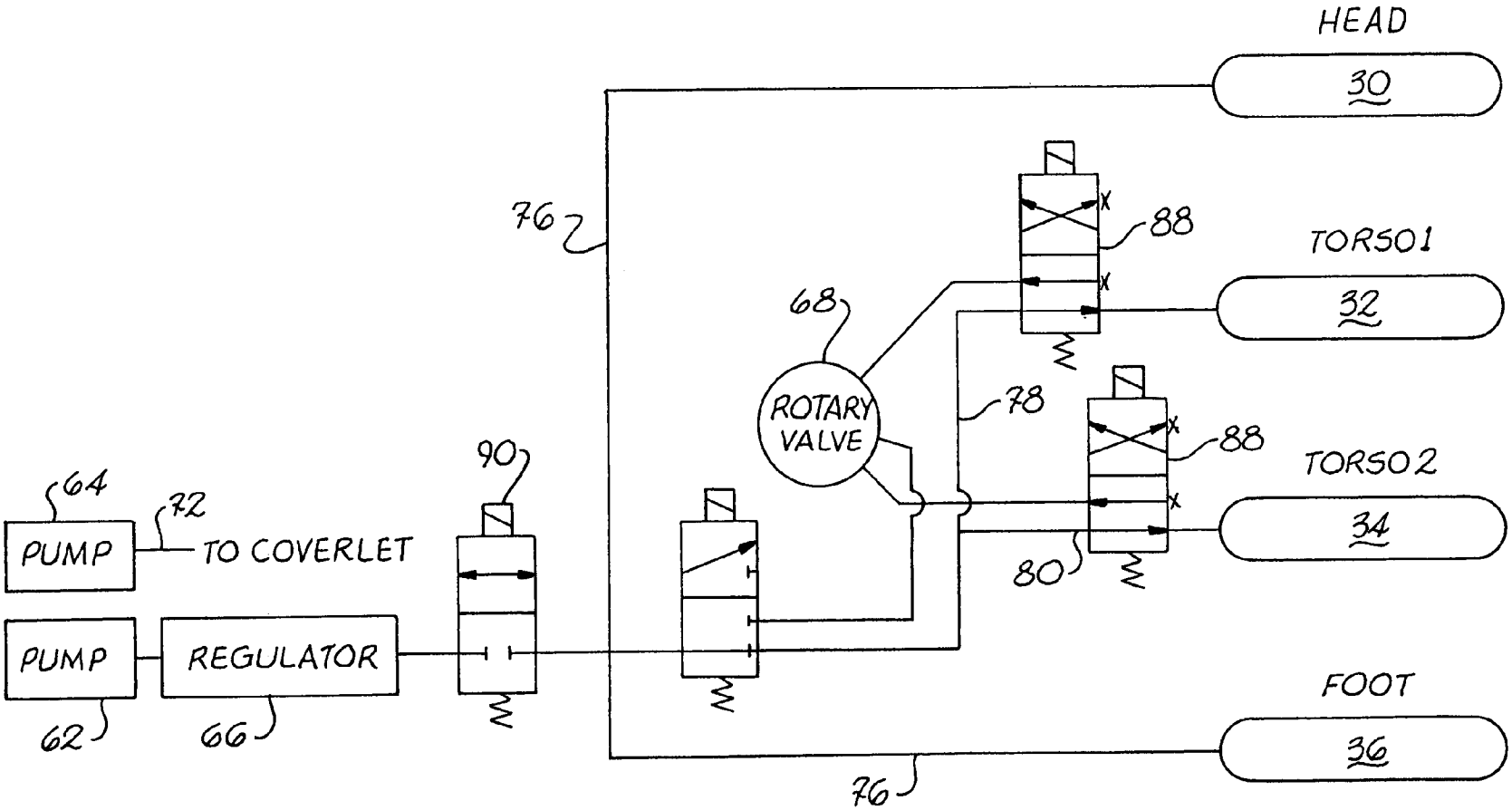
FIG. 6 is a schematic view of exemplary air flotation mattress air cell zones and the ECS which controls their inflation/deflation, and which in accordance with the subject invention separately provides for independent operation of the subject low air loss feature.
Figure 7:
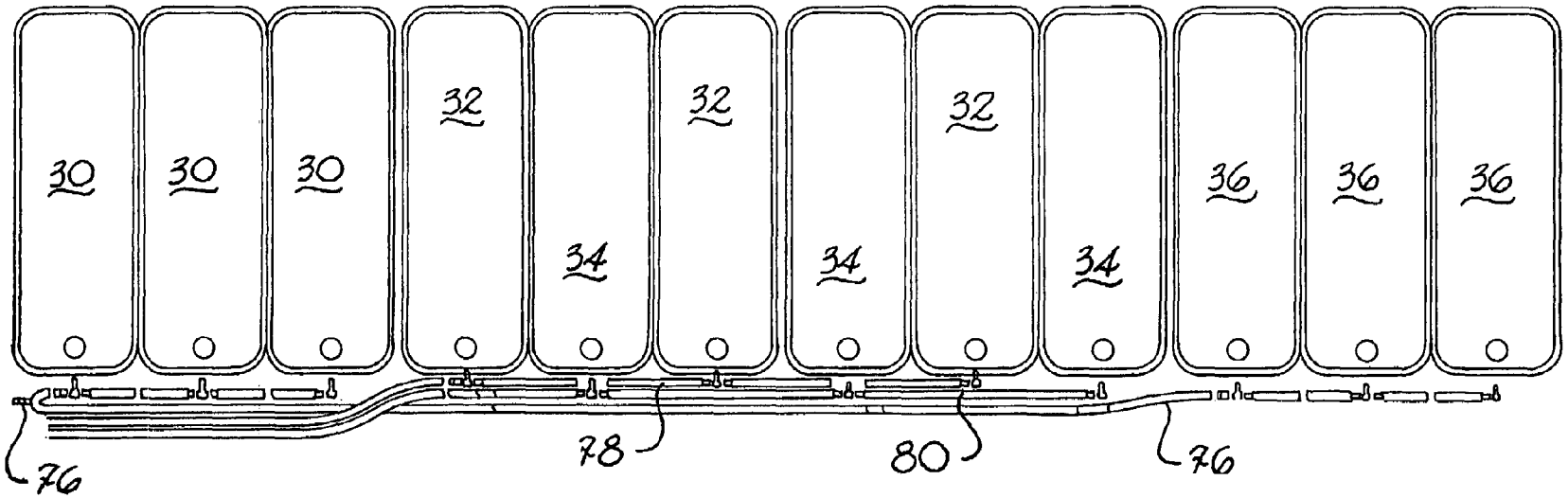
FIG. 7 is a schematic view of an exemplary arrangement of air flotation mattress air cells and their respective inflation tubing.
Figure 8:
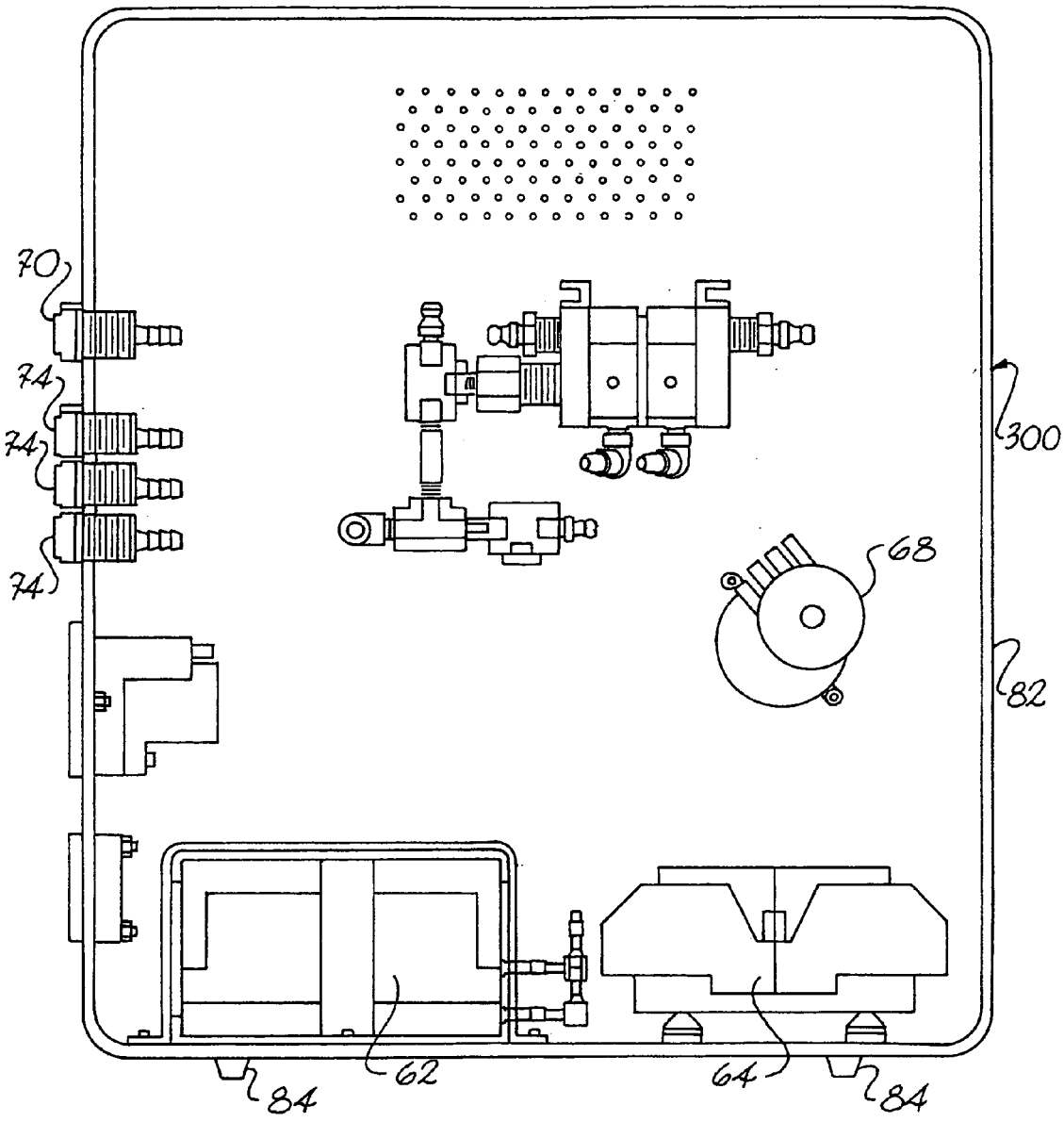
FIG. 8 is an exemplary internal schematic view of an ECS in accordance with the subject invention showing the two exemplary pumps used to respectively provide air for the air flotation mattress and the mattress coverlet, and showing an exemplary rotary valve which may be practiced in accordance with the subject invention.
Figure 9:
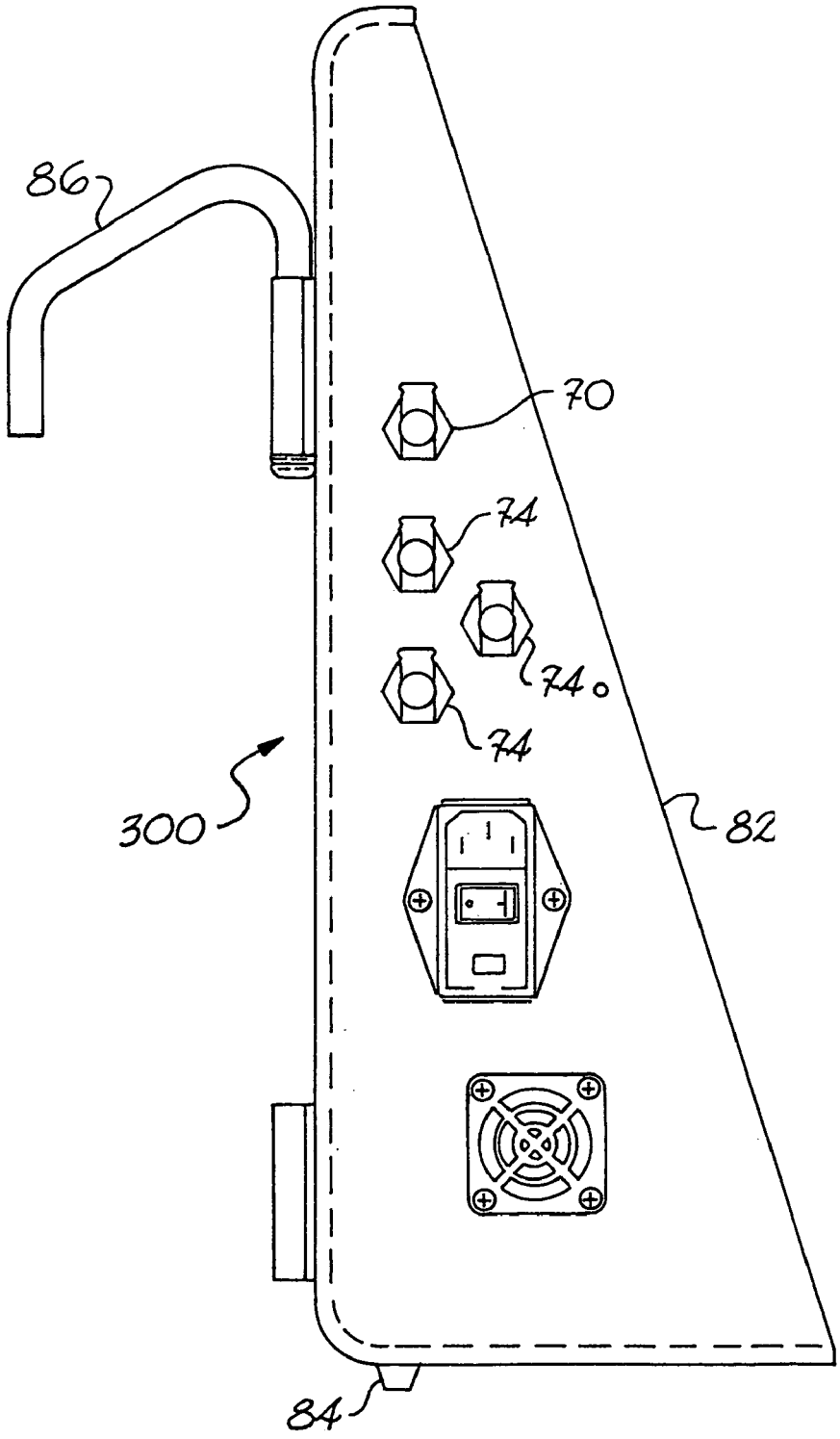
FIG. 9 is an external view of an exemplary ECS showing exemplary hanging hooks and rubber feet for supporting the ECS respectively on either the bedframe or the floor, as well as exemplary connection points for air flow passageways.

The cavity formed by the foam bolsters 22, header 26, and footer 28, contains the air cells 30, 32, 34 and 34. The air cells 30, 32, 34, and 36 are essentially inflatable air bladders connected directly to an external control system 300 via passageways 76, 78, and 80 (see FIGS. 6 and 7 and corresponding discussion) for their inflation/deflation. Such air cells 30, 32, 34, and 36 may be operated to provide the primary support surface for the patient.

There are twelve exemplary air cells 30, 32, 34 and 36. Other numbers thereof (or none at all) may be practiced in various embodiments of the subject invention. Such air cells 30, 32,34, and 36 are divided into four separate zones. The first exemplary zone (hereinafter the head zone) comprises three air cells 30 each of which may be maintained in an equal state of inflation/deflation relative to each other. The second exemplary zone (hereinafter the foot zone) comprises three air cells 36 each of which may be maintained in an equal state of inflation/deflation relative to each other.

Exemplary zones three and four together (all of the remaining cells) comprise the central or torso zone. Each of zones three and four comprise an alternating set of three air cells 32 and 34, respectively, within the torso zone. The torso zone (i.e., all six air cells 32 and 34) may be maintained at an equal state of inflation/deflation. As part of the capability of air flotation mattress 100 to provide alternating pressure support, zones three and four can alternate between specific states of inflation/deflation, thus dynamically changing the location of the support for the patient's torso. As part of the ECS 300, a firmness control may be provided which allows the user to specify the level of inflation of the air cells 30, 32, 34, and 36 both during the flotation and alternating pressure support treatment cycles.

Figure 2:
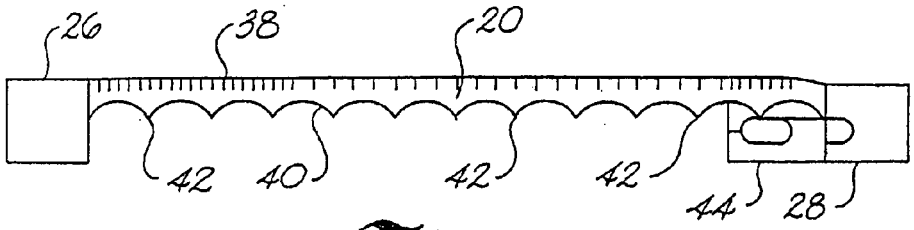
FIG. 2 is a cross-sectional view of the exemplary air flotation mattress shown in FIG. 1, taken along line 2/5-2/5 in FIG. 1, illustrating an exemplary foam shell topper (20) with a specific surface treatment, a foam header and footer, and including a foam block with a hole there-through for connection of air passageways to the exemplary air cells of the mattress.

As represented to those of ordinary skill in the art by the cross-sectional view of FIG. 2, the foam shell topper 20 of such air flotation mattress 100 may have on its upper surface 38 a GEO-MATT® surface treatment to aid in redistributing skin pressure. The bottom surface 40 of such foam shell topper 20 may be cut to provide predetermined ridges 42 running side-to-side to act as retainers for such air flotation mattress' respective air cells 30, 32, 34 and 36.

In order for the mechanical connections between the ECS 300 and both the mattress 100 and mattress coverlet 200 to be made an exemplary foam block 44 with a hole therethrough may be located at the end of one foam bolster and side 22 and 24, respectively.

Figure 3:
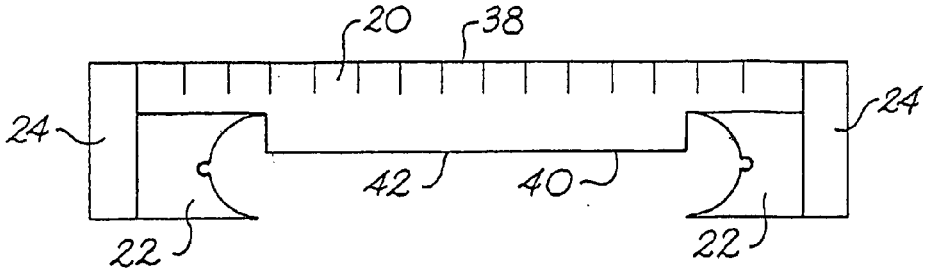
FIG. 3 is a cross-sectional view of the exemplary air flotation mattress shown in FIG. 1, taken along line 3-3 in FIG. 1, illustrating the construction of an exemplary foam shell of the mattress including an exemplary foam shell topper (20), bolsters and sides.

As best seen in the cross-sectional views of FIGS. 2 and 3, the foam shell topper 20 extends across almost the entire width and substantially the entire length of such mattress 100. The foam shell topper's 20 width extends from each foam side 24. Similarly, the topper's 20 length is terminated only by the foam header 26 and the foam footer 28. The bolsters 22 act as both supports for the connection between the topper 20 and the sides 24 and as retainers for the air cells 30, 32, 34, and 36.

Figure 4:
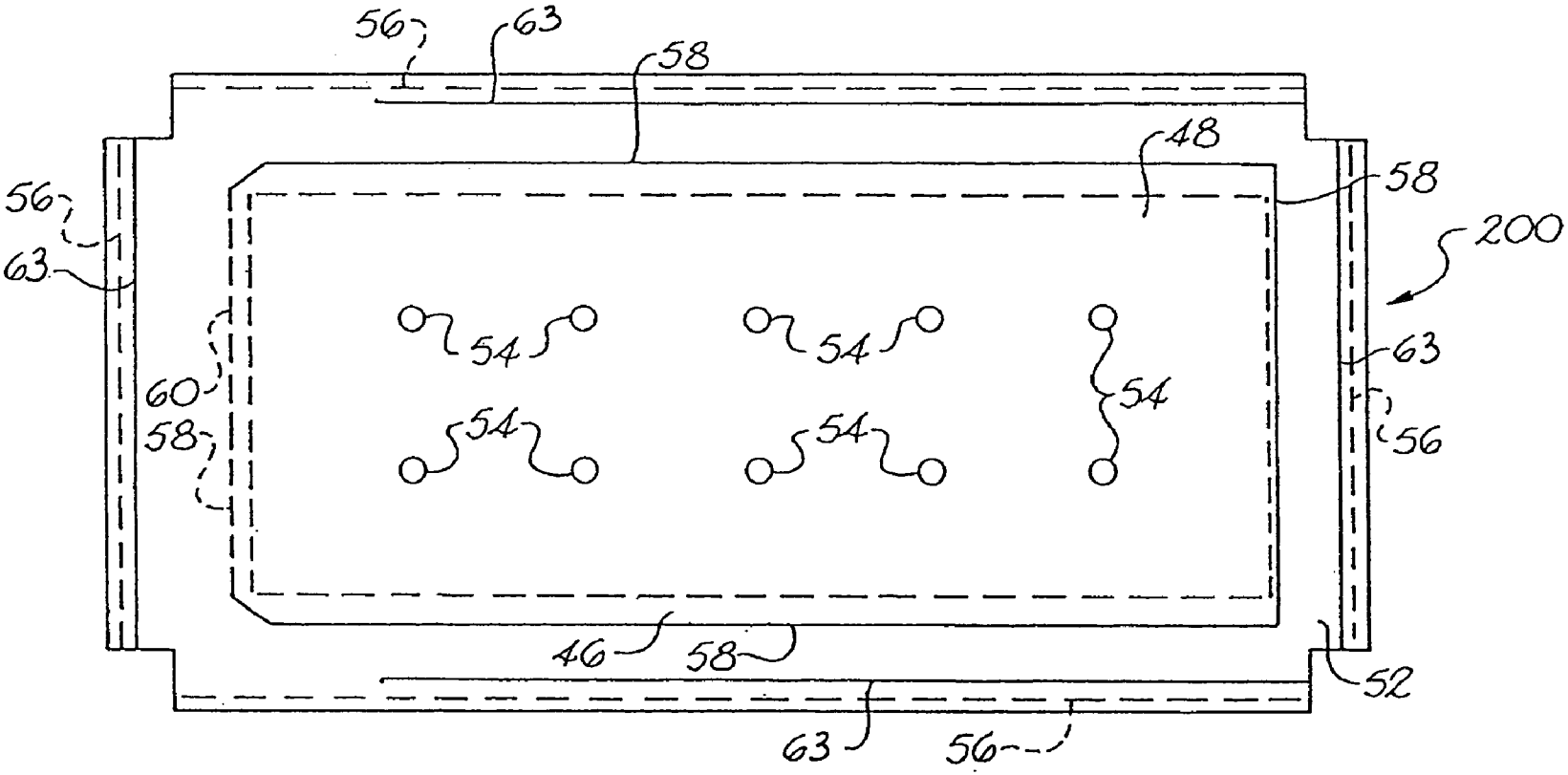
FIG. 4 is a top elevational view of the construction of an exemplary mattress coverlet showing numerous spot welds used in accordance with the subject invention to aid in the prevention of billowing, and showing exemplary air exhaust ports that provide an exit for the air flowing through the mattress coverlet during low air loss operation.
Figure 5:
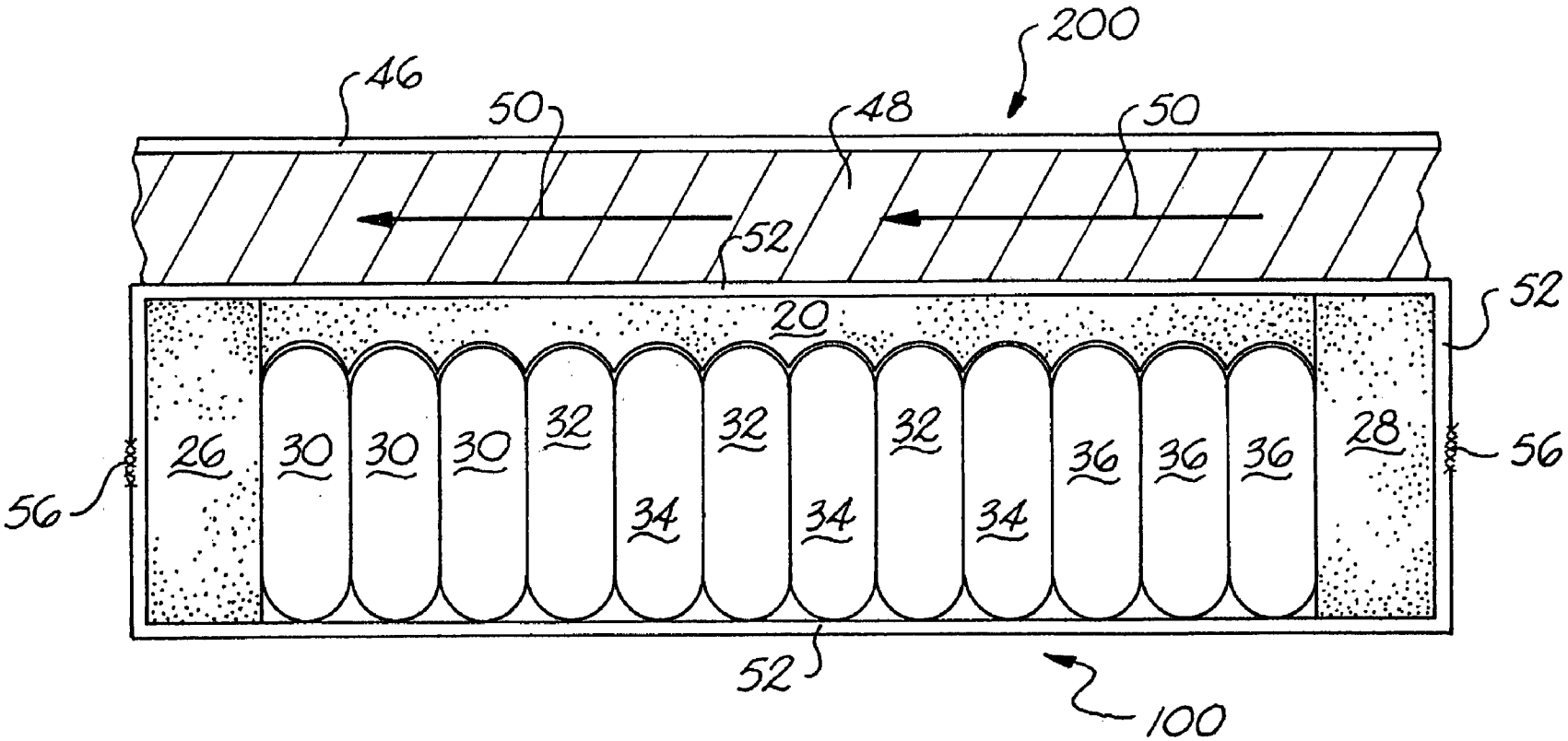
FIG. 5 is a cross-sectional view of the exemplary air flotation mattress shown in FIG. 1, taken along line 2/5-2/5 in FIG. 1, showing an exemplary three-layer mattress coverlet in accordance with the subject invention and otherwise illustrating exemplary foam shell topper (20), header and footer, and air cells of the mattress.

The exemplary mattress coverlet 200 is comprised of three separate layers. As seen in FIGS. 4 and 5, the first layer 46 of such mattress coverlet 200 is a sheet of waterproof, vapor permeable material. It is designed to allow moisture-vapor and heat from the patient's body or relatively immediately adjacent thereto to pass through to the second (i.e., middle) layer 48. The second layer 48 of such mattress coverlet 200 is a non-crush three-dimensional fabric that is moisture resistant and vapor and air permeable. It is through this middle layer 48 of the mattress coverlet 200 that the low air loss feature of the present invention forces air, which aids in removing the warm moist air generated by the patient. An exemplary depiction of the direction of airflow through the mattress coverlet 200 is indicated by exemplary airflow 50.

In accordance with the present preferred embodiment, the third layer 52 of the mattress coverlet 200 is a waterproof, vapor impermeable sheet. This final layer 52 acts as a retainer of the warm moist air generated by the patient and transmitted through the first layer 46 to the second layer 48. It maintains the warm moist air within the second layer 48 so it can be removed by the low air loss airflow (as indicated in FIG. 5 by exemplary air flow 50). Similarly, it acts as a boundary to prevent heat transfer from the air within the air flotation mattress's air cells 30, 32, 34, and 36, to the patient. Such third layer 52 may additionally comprise a zippered coverlet-mattress topper for encasing a mattress.

In other embodiments, an exemplary coverlet 200 in accordance with the subject invention may be modularly applied to other supports including mattresses, wheelchair/seating cushions, and/or patient positioners (whether air powered, pre-existing, disclosed herewith, or later developed). Several exemplary such support surfaces can be found in commonly owned U.S. Pat. No. 5,568,660 to Raburn et al; U.S. Pat. No. 5,797,155 to Maier et al.; and Des. 355,488 to Hargest et al., the disclosures of which are full incorporated herein by reference.

Some former mattress coverlets have suffered from the problem of billowing. As further represented in the top elevational view of present FIG. 4, in accordance with the present invention the occurrence of billowing may be reduced through the use of spot welds 54 of the first layer 46 to the third layer 52 in locations throughout the surface of the mattress coverlet 200. In making such spot-welds 54, small sections of the material of the second layer 48 of the mattress coverlet 200 have been removed to allow for an unimpeded welding of the first and third layers (46 and 52, respectively).

The mattress coverlet 200 is preferably constructed of a first layer 46 comprising a polyurethane coated polyester which is perimeter welded 58 to the third layer 52. Along the head end of the coverlet 200, where the first and third layer 46 and 52, respectively, are connected the perimeter weld 58 is intermittent to provide for exhaust air ports 60. It is through these exhaust air ports 60 that the warm moist air trapped within the second layer 48 is disposed.

The third layer 52 of the coverlet 200 preferably comprises a polyurethane coated nylon so as to be moisture and vapor impermeable. The second (i.e., middle) layer 48 is preferably a non-crush three-dimensional fabric. The third layer 52 additionally may have skirt welds 63 along substantially the entire perimeter of the material.

As best seen in FIG. 5, in the presently preferred exemplary embodiment, the third layer 52 forms a coverlet-mattress mattress topper, which may encase a mattress. The coverlet-mattress topper comprises an upper (i.e., the third layer 52 of the mattress coverlet 200) and lower sheet connected to two side panels, a head panel, and a foot panel in a bag-like configuration. Around the perimeter of the coverlet-mattress topper, running along the middle of the side, head, and foot panels is a zipper 56 for encasing a mattress within the topper. It is this coverlet-mattress topper that may maintain the mattress coverlet 200 in place despite the movement of the patient while on the support surface.

As will be clear to those of ordinary skill in the art from FIGS. 6-9 and their associated discussion, the air flotation mattress 100 and the mattress coverlet 200 are regulated by the ECS 300. The exemplary ECS 300 comprises two pumps 62 and 64, a regulator 66, a rotary valve 68, a single quick-disconnect connector 70 for connection of air passageway 72 to the mattress coverlet 200, and three quick-disconnect connectors 74 for connecting air passageways 76, 78, and 80 to the air flotation mattress air cells 30, 32, 34, and 36. Air is provided to the head and foot zones via air passageway 76 and is provided to zones three and four (i.e., the central or torso zone) via air passageways 78 and 80, respectively. The ECS features are preferably all within a stand-alone housing 82. The housing 82 is provided with rubber feet 84 for positioning the housing on the floor and with hooks 86 for hanging the ECS 300 from a bedframe.

The ECS 300 has two pumps 62 and 64 for separate operation of the air flotation mattress 100 and the mattress coverlet 200. The first pump 62 operates the air flotation mattress 100. It is preferably a pump which provides quiet operation and a quick response to an inflation request. The second pump 64 functions to provide air for the low air loss system in the mattress coverlet 200. The low air loss system pump 60 64 is preferably a pump which provides a higher air flow rate for the mattress coverlet 200 than would be provided by the air flotation mattress pump 62.

The first pump 62 operates in connection with a regulator 66 and a rotary valve system 68 to provide air for the air flotation mattress 100. In operation of this exemplary embodiment, the air provided to the head and foot zones (i.e., exemplary air cells 30 and 36, respectively) is delivered through a first passageway 76. This first passageway 76 serves to interconnect the head and foot zones to insure consistent inflation/deflation. The air provided to the torso zone, exemplary air cells 32 and 34, respectively, enters through separate passageways 78 and 80, respectively. With each of the passageways 78 and 80 associated with the torso zone are control valves 88 to either allow inflation/deflation or to maintain the current state of inflation/deflation of the air cells 32 and/or 34. Such valves 88 are separately operable which allows for the provision of an alternating pressure support surface within the air flotation mattress 100. When the control valves 88 within passageways 78 and 80 are set to mimic the inflation/deflation of the head and foot zones, the air flotation mattress 100 is able to provide a static support surface. The construction of such valves 88 and pumps 62 and 64 are well known to those of ordinary skill in the art, and details thereof form no particular part of the subject invention.

The second pump 64 may be operated in accordance with the subject invention to provide a continuous flow of air to the low air loss mattress coverlet 200. As shown in FIG. 4, the first layer 46 of the mattress coverlet 200 contains air exhaust ports 60 for the expulsion of the low air loss air flow through the mattress coverlet 200. An air input port (not shown) is preferably generally located at the foot end of the mattress coverlet 200 and the air exhaust ports 60 are preferably located at the opposite end of the mattress coverlet 200. However, one of ordinary skill in the art will recognize that alternative configurations of such features fall within the scope and spirit of the present invention.

In operation, the ECS 300 functions to provide the user the widest variety of treatment options. The user can select from either a static pressure support surface, in which the air flotation mattress 100 maintains a consistent inflated state across all zones, or an alternating pressure support surface, in which the head and foot zones maintain a consistent inflation state and zones three and four within the torso zone dynamically fluctuate between opposed states of inflation/deflation, respectively. In addition to the choice of support surface function to be provided by the air flotation mattress 100, the ECS 300 allows the user to choose whether or not to allow the operation of the low air loss mattress coverlet 200 to aid in removing warm moist air away from the patient's skin. It is this wide range of user (and/or caregiver) choice in treatment methods and its modularity that allows the system, the air flotation mattress 100, the low air loss mattress coverlet 200 and the ECS 300, to be so flexible.

Additionally, in emergency operations, the system is designed to be as flexible as possible in order to aid in the treatment of the patient. Should the need arise to quickly provide a more sturdy surface for the patient, such as in the case where a patient suffers a heart attack and requires chest compression, the present invention provides the user three options: inflate the air flotation mattress 100 fully by utilizing the static support surface feature, terminate the operation of the pumps and allow the air flotation mattress to deflate, or to utilize the quick-disconnect connectors 74 between the ECS 300 and the air passageways 76, 78, and 80 to allow for complete deflation of the air flotation mattress 100.

Similarly, when there is a loss of power to the ECS 300, the system is designed to retain its functionality to aid in the treatment of the patient. The air flotation mattress is designed to maintain the inflation pressure within the air cells 30, 32, 34, and 36. It performs such function by allowing the pressure across all the cells 30, 32, 34, and 36 to even out and become consistent (as when utilizing the static pressure support surface feature). The system is able to maintain the air within the cells through the use of several three-way control valves 88 which open to allow communication between the air cells 30, 32, 34, and 36 and through the use of a two-way control valve 90 which closes to deny an exit path for the air already in the system.

An alternative presently preferred embodiment may comprise an air flotation mattress 100 with a multi-layer mattress topper 400 and/or mattress coverlet 200 for the prevention and treatment of decubitus ulcers (pressure sores and bedsores). The mattress coverlet 200 provides a low air loss feature that can be turned on or off as desired by the user (here, broadly referencing a patient or person resting on such coverlet and/or a caregiver therefor).

Figure 10:
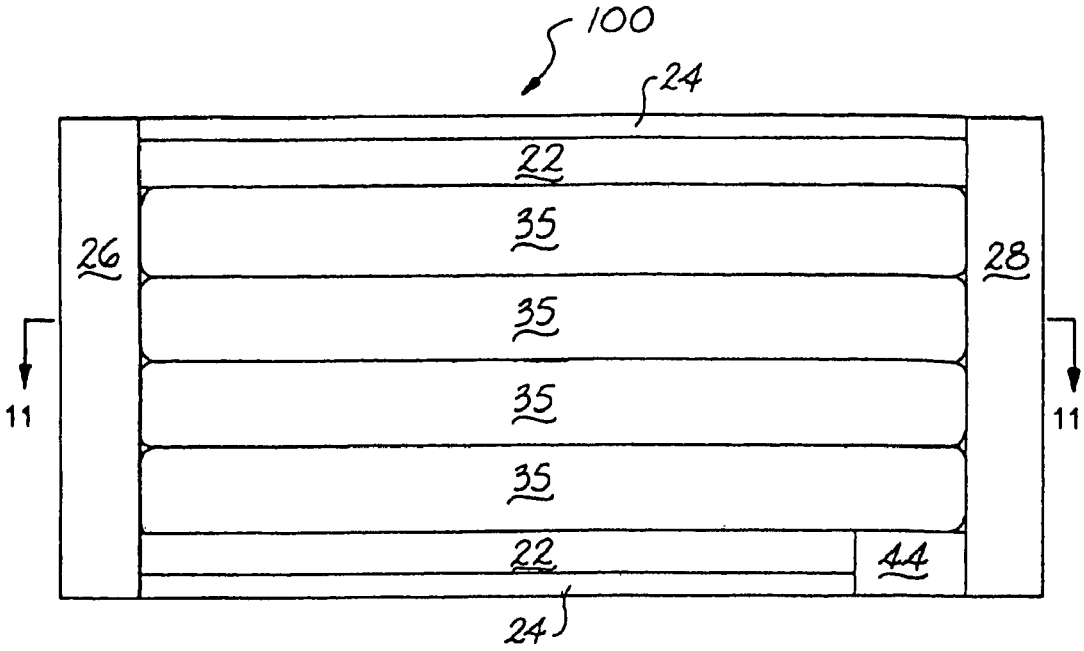
FIG. 10 is a bottom elevational view of an exemplary air flotation mattress in accordance with the subject invention with exemplary foam bolsters, sides, header, and footer, and individual air cell features of such exemplary mattress running head-to-foot.

As best seen in FIG. 10, a foam shell topper 20 with foam bolsters 22 and foam sides 24 running the length of the mattress 100 on either side forms the air flotation mattress 100. At the respective ends of the air flotation mattress 100 and capping the foam bolsters and sides 22 and 24, respectively, are a foam header 26 and foam footer 28, which along with the bolsters 22 form a cavity in the mattress 100. This cavity is for positioning of air cells 35. Unlike the above-preferred embodiment, the air cells 35 of the presently preferred embodiment run head-to-foot with such cavity.

As above, the cavity formed by the foam bolsters 22, header 26, and footer 28, contains the air cells 35. The air cells 35 are essentially inflatable air bladders connected directly to an external control system 300 as above described for their inflation/deflation. Such air cells 35 are operated to provide the primary support surface for the patient.

As represented to those of ordinary skill in the art by the cross-sectional view of FIG. 2, the foam shell topper 20 of such air flotation mattress 100 may have on its upper surface 38 a GEO-MATT® surface treatment to aid in redistributing skin pressure. The bottom surface 40 of such foam shell topper 20 may be alternatively cut to provide predetermined ridges 42 running head-to-foot to act as retainers for such air flotation mattress' respective air cells 35.

In accordance with this alternative presently preferred embodiment, the mattress coverlet 200 may be additionally sheathed in a multi-layer mattress topper 400. The first layer 51 of the multi-layer mattress topper 400 is a waterproof, vapor impermeable sheet. The second (i.e., middle) layer 53 may comprise a non-crush three-dimensional fabric, such as a knit, cloth, polymeric film, foam or extruded woven fibers. Finally, the third layer 52 may additionally comprise a waterproof, vapor impermeable sheet for protection of the underlying mattress coverlet 200. Such third layer 52 may additionally comprise a zippered sheath for encasing the mattress coverlet 200.

Figure 11:
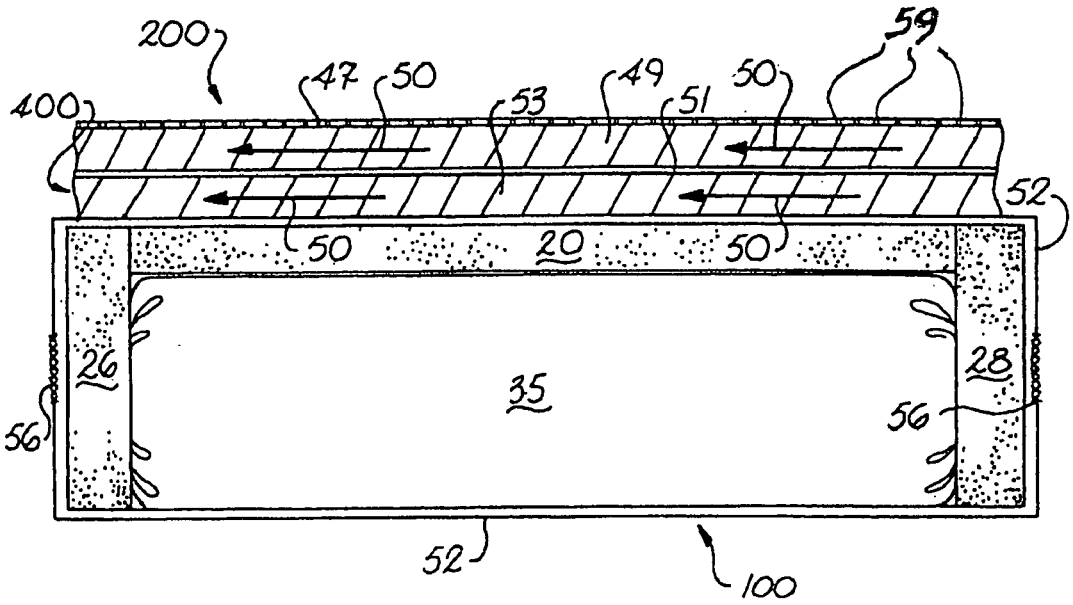
FIG. 11 is a cross-sectional view of the exemplary air flotation mattress shown in FIG. 10, taken along line 11-11 in FIG. 10, showing an exemplary multi-layer mattress coverlet and a multi-layer mattress topper in accordance with the subject invention and otherwise illustrating an exemplary foam shell topper (20), header and footer, and such head-to-foot air cells of the mattress.

The exemplary mattress coverlet 200 is comprised of two separate layers. As seen in FIG. 11, the first layer 47 of such mattress coverlet 200 is a sheet of waterproof, vapor permeable material. It is designed to allow moisture-vapor and heat from the Patient's body or relatively immediately adjacent thereto to pass through (such as perforations or relatively small holes 59 in layer 47) to the second layer 49. The second layer 49 of such mattress coverlet 200 is a non-crush three-dimensional fabric that is moisture resistant and vapor and air permeable. It is through this middle layer 49 of the mattress coverlet 200 that the low air loss feature of the present invention forces air, which aids in removing the warm moist air generated by the patient. An exemplary depiction of the direction of airflow through the mattress coverlet 200 is indicated by exemplary airflow 50.

The two layers 47 and 49 of the mattress coverlet 200 are sewn together around their perimeter. Various methods of attaching such a coverlet 200 may be utilized. For example, said coverlet 200 may be formed with an elastic band sewn around its outer perimeter so as to envelop such a mattress 100 as would a fitted sheet.

In the case of a "fitted-sheet" style coverlet 200, the entirety of the outer perimeter of the first and second layers 47 and 49, respectively, may be sewn together. In such an embodiment, the forced air from the ECS 300 along with the warmth and moisture from the air in the second layer 49 of the coverlet may escape around the entire perimeter through the loose friction fit of the elastic band of the coverlet 200. As described above, this alternative presently preferred embodiment may be regulated by an ECS 300. The two pumps 62 and 64 of the ECS 300 serve to provide the airflow for both the primary patient support (i.e., the mattress 100 and the airflow through the middle layer 53 of the multi-layer mattress topper 400) and for the mattress coverlet 200. The method of connection of the ECS 300, its operation and features is as discussed in detail above.

As in other embodiments, the exemplary coverlet 200 in accordance with the subject invention may be modularly applied to other supports including mattresses, wheelchair/seating cushions, and/or patient positioners (whether air powered, pre-existing, disclosed herewith, or later developed).

It is to be understood that the present invention may be practiced in conjunction with combinations of additional features, not necessarily shown or discussed in detail. In particular, the size, shape and support characteristics of the air flotation mattress 100, the multi-layer mattress topper 400 and/or the mattress coverlet 200 may vary as desired or as needed. Additionally, both the mattress coverlet 200 and the multi-layer mattress topper 400 may be utilized with mattresses of various size and shape (regardless of whether air powered, pre-existing, disclosed herewith, or later developed), in addition to being useful with other support devices such as patient positioner and wheelchair/seating cushions. All such variations, as would be understood by one ordinarily skilled in the art are intended to fall within the spirit and scope of the present invention. Likewise, the foregoing presently preferred embodiments are exemplary only, and their attendant descriptions are similarly intended to be examples of the present invention rather than words of limitation.

What is claimed is:

1. A patient support system for the prevention and treatment of decubitus ulcers, said patient support system comprising:

a foam shell defining an internal cavity for housing a plurality of air cells;

a plurality of air cells housed in said foam shell internal cavity;

a multi-layer mattress topper comprising at least one vapor impermeable layer encasing said foam shell;

a multi-layer mattress coverlet, said coverlet providing a low air loss feature; and an external control system, wherein said external control system selectively provides a continuous stream of air through at least one layer of said multi-layer mattress coverlet for selectively providing said low air loss feature thereof, while independently of said low air loss feature also providing air drive for said plurality of air cells.

2. A patient support system as set forth in claim 1, wherein:

said foam shell is a multi-piece foam shell comprising a foam shell topper, foam bolsters, a foam header, and a foam footer; and wherein said plurality of air cells are oriented from head-to-foot within said foam shell.

3. A patient support system as set forth in claim 1, wherein said multi-layer mattress topper comprises three layers.

4. A patient support system as set forth in claim 3, wherein:

said three layers of said multi-layer mattress topper comprise:

a first layer of a water-proof, vapor-impermeable material;

a middle layer of a non-crushable, three-dimensional fabric; and a third layer of a water-proof, vapor-impermeable material; and further wherein said external control system selectively provides a continuous stream of air through said middle layer of said multi-layer mattress topper.

5. A patient support system as set forth in claim 4, wherein said first and said third layers are welded together about their periphery.

6. A patient support system as set forth in claim 5, wherein said third layer further forms a zippered sheath for encasing said foam shell and its associated air cells.

7. A patient support system as set forth in claim 1, wherein said multi-layer mattress coverlet comprises two layers.

8. A patient support system as set forth in claim 7, wherein:

said two layers of said mattress coverlet comprise:

an upper layer of a high moisture vapor transfer rate material; and a lower layer of a non-crushable, three-dimensional fabric;

further wherein said continuous stream of air provided by said external control system through at least one layer of said multi-layer mattress coverlet comprises an airflow provided by said external control system through said lower layer of said mattress coverlet.

9. A patient support system as set forth in claim 8, wherein said upper layer is perforated to enhance said high moisture vapor transfer rate.

10. A patient support system as set forth in claim 1, wherein said external control system comprises a fully self-contained unit for providing inflationary airflows to said air cells, said multi-layer mattress topper, and said mattress coverlet.

11. A patient support system as set forth in claim 10, wherein said external control system houses a plurality of pumps for providing said inflationary airflows.

12. A patient support system as set forth in claim 11, wherein said plurality of pumps operate independently of one another so as to allow alternate or simultaneous use of said air cells and so as to allow respective use of said multi-layer mattress topper, as well as, said low air loss feature of said mattress coverlet.

13. A patient support system for the prevention and treatment of decubitus ulcers, said patient support system comprising:

a foam shell defining an internal cavity for housing a plurality of air cells;

a plurality of air cells housed in said foam shell internal cavity;

a multi-layer mattress topper encasing said foam shell;

a multi-layer mattress coverlet, said coverlet providing a low air loss feature;

an external control system;

wherein said multi-layer mattress topper comprises a first layer of a water-proof, vapor-impermeable materials, a middle layer of a non-crushable, three-dimensional fabric, and a third layer of a water-proof, vapor-impermeable materials;

wherein said external control system selectively provides a continuous stream of air through said middle layer of said multi-layer topper; and wherein said first and said third layers of said multi-layer topper are welded together about their periphery.

14. A patient support system as set forth in claim 13, wherein said foam shell further comprises a foam shell topper.

15. A patient support system as set forth in claim 13, wherein said multi-layer mattress coverlet comprises two layers.

16. A patient support system as set forth in claim 15, wherein:

said two layers of said multi-layer mattress coverlet comprise:

an upper layer of a high moisture vapor transfer rate material; and a lower layer of a non-crushable, three-dimensional fabric; and further wherein said external control system selectively provides an airflow through said lower layer of said multi-layer mattress coverlet for selectively providing said low air loss feature thereof.

17. A patient support system as set forth in claim 16, wherein said upper layer is perforated to enhance said high moisture vapor transfer rate.

* * * * *